US006966711B2

(12) United States Patent
Miller et al.

(10) Patent No.: US 6,966,711 B2
(45) Date of Patent: Nov. 22, 2005

(54) DYNAMIC REGISTRATION DEVICE FOR MAILING SYSTEM

(75) Inventors: John P. Miller, Shelton, CT (US); Lun Chan, New Fairfield, CT (US); Anthony E. Yap, Southington, CT (US)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 10/742,305

(22) Filed: Dec. 18, 2003

(65) Prior Publication Data

US 2005/0135859 A1 Jun. 23, 2005

(51) Int. Cl.[7] ..... B41J 11/20
(52) U.S. Cl. ..... 400/55; 400/56; 271/274
(58) Field of Search ..... 400/55, 56, 59, 400/622; 271/274

(56) References Cited

U.S. PATENT DOCUMENTS 4,821,049 A 4/1989 Eckl
5,325,114 A * 6/1994 Fogle et al. ..... 347/220
5,339,280 A * 8/1994 Goldberg et al. ..... 346/134
5,683,187 A * 11/1997 Tunmore ..... 400/58
5,806,994 A * 9/1998 Coffy et al. ..... 400/120.01
6,019,526 A * 2/2000 Herbert ..... 400/58
6,024,429 A * 2/2000 Coffy et al. ..... 347/7
6,048,048 A * 4/2000 Gregoire ..... 347/40
6,179,419 B1 1/2001 Rasmussen et al.
6,431,778 B1 8/2002 Coudray et al.
6,692,166 B2 * 2/2004 Ansell et al. ..... 400/56
2004/0119223 A1 * 6/2004 Miller et al. ..... 271/3.14

* cited by examiner

*Primary Examiner*—Ren Yan
*Assistant Examiner*—Dave A. Ghatt
(74) *Attorney, Agent, or Firm*—Brian A. Lemm; Angelo N. Chaclas

(57) ABSTRACT

A dynamic registration device for a mailing system that reduces the problems of dust generation, ink smearing, and print head contact is provided. The biasing force normally applied to the back panel of a mail piece, such that the front panel maintains contact with a registration plate, is controlled by an actuator such that the force can be removed when the printing module is not performing the actual printing process. Thus, the biasing force can be applied only when the print head is actually printing and the biasing force can be removed once printing has been completed. In other embodiments utilizing multiple printing modules, when one of the printing modules is inactivated, the biasing force can be removed, and the mail pieces pass through the inactive printing module without being registered against the top registration plate.

18 Claims, 4 Drawing Sheets

DYNAMIC REGISTRATION DEVICE FOR MAILING SYSTEM

FIELD OF THE INVENTION

The invention disclosed herein relates generally to mailing systems, and more particularly to a dynamic registration device for a mailing system.

BACKGROUND OF THE INVENTION

Mailing systems, such as, for example, a mailing machine, inserter, and the like, often include different modules that automate the processes of producing mail pieces. A typical mailing system includes a variety of different modules or sub-systems each of which performs a different task on the mail piece. The mail piece is conveyed downstream utilizing a transport mechanism, such as rollers or a belt, to each of the modules. In a mailing machine, such modules could include, for example, a singulating module, i.e., separating a stack of mail pieces such that the mail pieces are conveyed one at a time along the transport path, a moistening/sealing module, i.e., wetting and closing the glued flap of an envelope, a weighing module, and a metering/printing module, i.e., applying evidence of postage to the mail piece. In an inserter, such modules could include one or more feeders and collators, an envelope stuffing module, a moistening/sealing module, i.e., wetting and closing the glued flap of an envelope, a weighing module, and a metering/printing module, i.e., applying evidence of postage to the mail piece. The exact configuration of the mailing system is, of course, particular to the needs of the user.

Some high speed mailing systems may utilize more than one printing module in series. For example, some high speed inserter systems can process up to 22,000 mail pieces per hour. The printing modules in such high speed systems require maintenance at periodic intervals to clean the print heads, replace ink cartridges, etc. Such maintenance requires the print module to be inactive, i.e., not perform any print operations, for a certain period of time. In high speed systems, it would be required to stop the system completely to allow this maintenance period to occur. Because of the high volume of mail pieces processed, even very short periods of down-time for maintenance can significantly impact the throughput of the system. For example, halting a system that typically process 22,000 pieces per hour for only two minutes will reduce the throughput by 733 pieces per hour. If the maintenance is required to be performed at least once per hour, in an eight hour day the throughput of the machine will be decreased by almost 6,000 pieces. To minimize any down-time of the system, it is known to place two print heads or modules (collectively referred to hereinafter as print or printing modules) in series along the transport path, where only one of the printing modules is activated at a time. Thus, when one of the printing modules requires maintenance operations, it can be inactivated and the other printing module activated to print on the mail pieces. For example, if the first printing module requires maintenance, the first printing module is inactivated and the second printing module is activated. Mail pieces will pass through the first printing module, without being imprinted upon, to the second printing module, where printing will occur. When the second printing module requires maintenance, the second printing module is inactivated and the first printing module is activated. Mail pieces will be imprinted upon by the first printing module and will pass through the second printing module without being imprinted with any information.

Modern mailing systems utilize digital printing techniques for producing images on a mail piece. Conventional digital printing techniques include bubble jet and ink jet, each of which produces an image in a dot matrix pattern. With digital printing, individual print head elements (such as resistors or piezoelectric elements) are selectively electronically stimulated to expel drops of ink from a reservoir onto a substrate, e.g., a mail piece. In either case, by controlling the timing of energizing of the individual print head elements in conjunction with the relative movement between the print head and the mail piece, a dot matrix pattern is produced in the visual form of the desired image. In the case of mailing systems, the image may be, for example, an indicium that evidences payment of postage.

Digital printing technology has significant advantages when used in a mail handling apparatus as compared to older technology that utilized either a flat platen or a rotary drum to imprint information, such as, for example, address information or an indicium, on mail pieces. For example, if some variable image data needs to be changed, it can easily be done through the installation of new or upgraded software versus having to replace the entire printing module, since the flat platen and drum are typically not separately removable. Moreover, greater printing speeds can be obtained as compared to conventional mechanical printing systems. However, the use of a digital print head in a mailing system presents other issues that must be taken into consideration. For example, for the ink jet nozzles of an ink jet printer to properly deposit ink on the surface of the receiving medium, it is critical that a small predetermined gap be maintained between the exit plane of the nozzles and the surface of the receiving medium, typically in the order of one sixteenth to one thirty-second of an inch. This gap is necessary to achieve acceptable image quality, since too small a gap causes scuffing of the print head and to large a gap results in inaccurate dot placement, with either situation resulting in a deteriorated print image. Thus, in the mail handling environment, it becomes necessary to maintain this critical gap between the exit plane of the ink jet nozzles and the upper surface of the mail pieces being conveyed through the mailing machine.

To accomplish this, the mail pieces, such as, for example, envelopes, postcards, flats, and the like, must be conveyed with the front panels on which the information is printed lying in a fixed registration plane, which is disposed beneath the exit plane of the nozzles a distance equal to the aforementioned gap. This arrangement is referred to hereinafter as top registration. To accomplish this top registration, a biasing force is applied to the back panel of the mail piece such that the front panel maintains contact with a registration plate. An opening is provided in the registration plate, above which the print head is located such that the print head can print on the mail piece as it passes the opening in the registration plate.

There are problems, however, with the conventional top registration transports in mailing systems. For example, friction between the mail piece and registration plate results in the generation of paper dust. The presence of dust within a mailing system can cause several problems, including, for example, clogging the nozzles of the print head. Dust accumulation can also interfere with maintenance operations performed by the mailing system on the print head, including, for example, wiping and capping of the print head.

Another problem with top registration is the potential for the trailing edge of a mail piece to hit the print head as it is transported past the print head, thereby potentially damaging the print head. Systems with multiple printing modules present additional problems with conventional top registration. For example, even though one of the printing modules is inactivated, i.e., not printing, the mail pieces still must pass through both print modules. Although printing is not occurring in one of the modules, the mail pieces are still transported through the inactive printing module in a top registration position. Thus, the front panel of the mail piece is still in contact with registration plate, resulting in the generation of additional paper dust. Having to pass each mail piece through two printing modules will double the amount of paper dust generated, thereby increasing the risk of associated problems. Another problem with multiple printing modules is the smearing of ink printed on a mail piece by the first print module as the mail piece passes through the second print module. There is insufficient time for the ink deposited on a mail piece by the first print module to dry before the mail piece reaches the second print module. As such, the wet ink can smear when the mail piece makes contact with the registration plate of the second print module. The smearing of the ink can result in unreadable information. This is especially critical in the case of an indicium that includes a bar code that must be scanned for verification purposes. If the bar code is unreadable, the indicium cannot be verified and the mail piece may not be delivered.

Thus, there exists a need for a top registration device for a mailing system that reduces the problems of dust generation, ink smearing, and contact of the print head by the trail end of a mail piece.

SUMMARY OF THE INVENTION

The present invention alleviates the problems associated with the prior art and provides a top registration device for a mailing system that reduces the problems of dust generation, ink smearing, and contact of the print head by the trailing edge of a mail piece.

In accordance with an embodiment of the present invention, the biasing force normally applied to the back panel of the mail piece, such that the front panel maintains contact with the top registration plate, is controlled by an actuator such that the force can be selectively applied and removed. In some embodiments, the biasing force can be applied only when the print head is actually printing and removed once printing has been completed. Since the biasing force will not be present along the entire length of the mail piece, the amount of paper dust generated can be reduced, and the risk of the trailing edge of the mail piece contacting the print head is significantly reduced. In other embodiments utilizing multiple printing modules, when one of the printing modules is inactivated, the biasing force can be removed, and the mail pieces pass through the inactive printing module without being registered against the top registration plate. Thus, if a first printing module imprints upon the mail pieces, the ink will not be smeared as the mail pieces pass through the inactive second printing module.

In an embodiment of the invention, a rotary actuator is provided that is controlled to selectively apply the biasing force to register a mail piece with the top registration plate. In embodiments with multiple printing modules, the actuator can selectively apply the biasing force for one of the printing modules. The biasing force can be removed when printing has been completed, thereby reducing the generation of paper dust and the risk of the print head being contacted by the trailing edge of a mail piece.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, by way of example serve to explain the invention in more detail. As shown throughout the drawings, like reference numerals designate like or corresponding parts.

DETAILED DESCRIPTION OF THE PRESENT INVENTION

Figure 1:
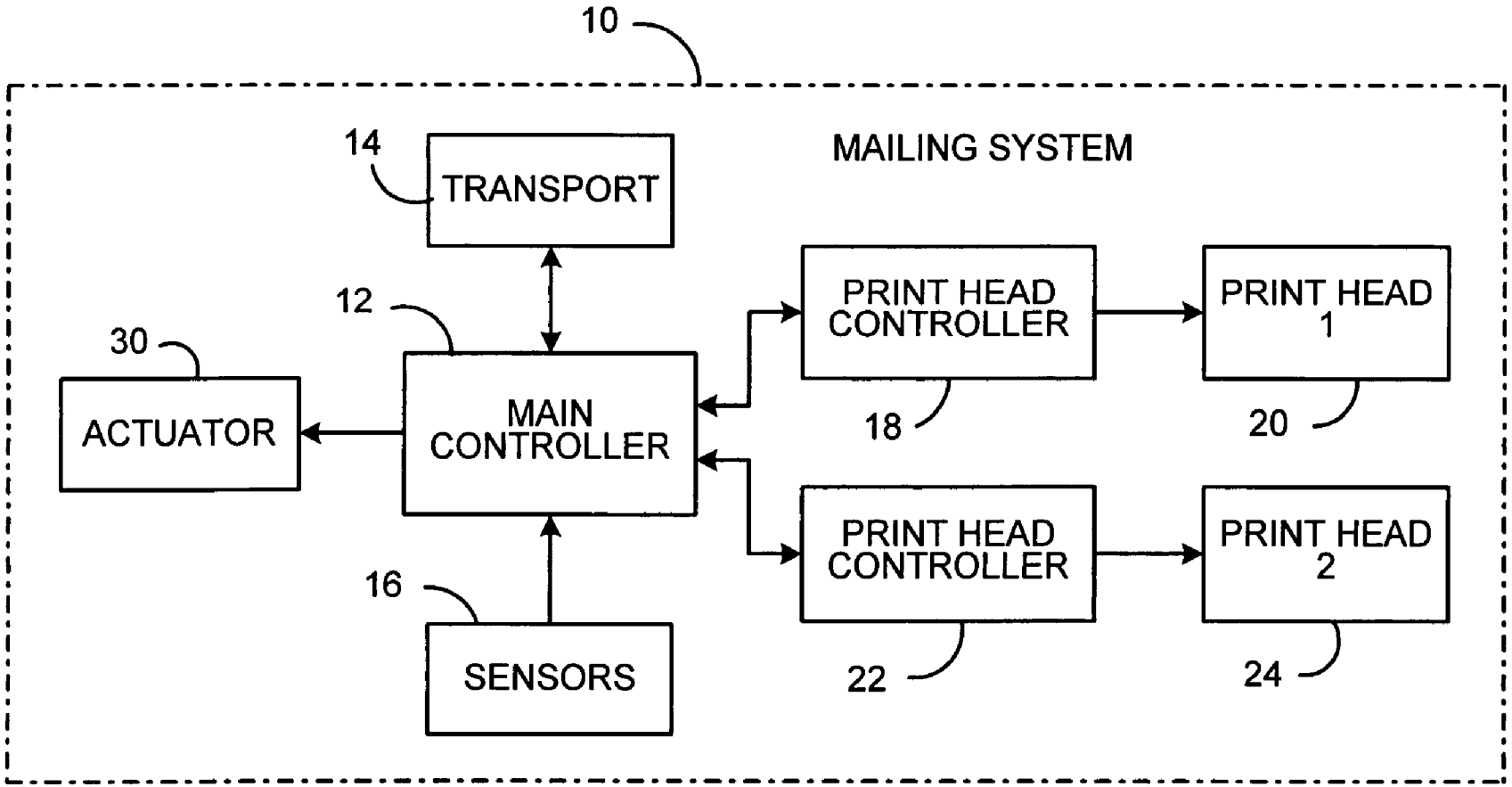
FIG. 1 illustrates in block diagram form portions of a mailing system according to an embodiment of the present invention.

In describing the present invention, reference is made to the drawings, wherein there is seen in FIG. 1 in block diagram form portions of a mailing system 10 that includes a dynamic registration device according to embodiments of the invention. Mailing system 10 includes a main controller 12 that controls one or more operations of the mailing system 10. Main controller 12 may be implemented as hardware, firmware, as a general or special purpose processor that executes commands in response to software, or any combination thereof. A transport 14 is utilized to move articles, such as, for example, mail pieces, including envelopes, flats, postcards, and the like, through the mailing system 10. Transport 14 can be implemented in any conventional manner, such as, for example, a combination of rollers and belts as is well known. One or more sensors 16, located along the transport 14, provide the main controller 12 with status signals as to the location of an article along the transport 14. Sensors 16 can be implemented as optical sensors that are triggered by an article passing through a beam.

Mailing system 10 is provided with two print modules. The first print module includes a print head controller 18, coupled to the main controller 12, that drives a first print head, Print Head 1 (PH1), 20. The second print module is similar to the first and includes a print head controller 22, coupled to the main controller 12, that drives a second print head, Print Head 2 (PH2), 24. PH1 20 and PH2 24 are located in series along the transport 14, with PH1 20 being upstream of PH2 24. The print heads 20, 24 utilize digital printing technology. Accordingly, as transport 14 moves the articles past the print heads 20, 24, the articles are top registered to maintain the necessary gap between the nozzles of the print heads 20, 24 and the printing surface. Mailing system 10 is further provided with an actuator 30 that dynamically positions the articles in a top registration position based on which of the print heads 20, 24 is activated, i.e., actually printing, according to an embodiment of the present invention. Additionally, in other embodiments, the top registration positioning can be based on the actual print cycle timing.

Figure 2:
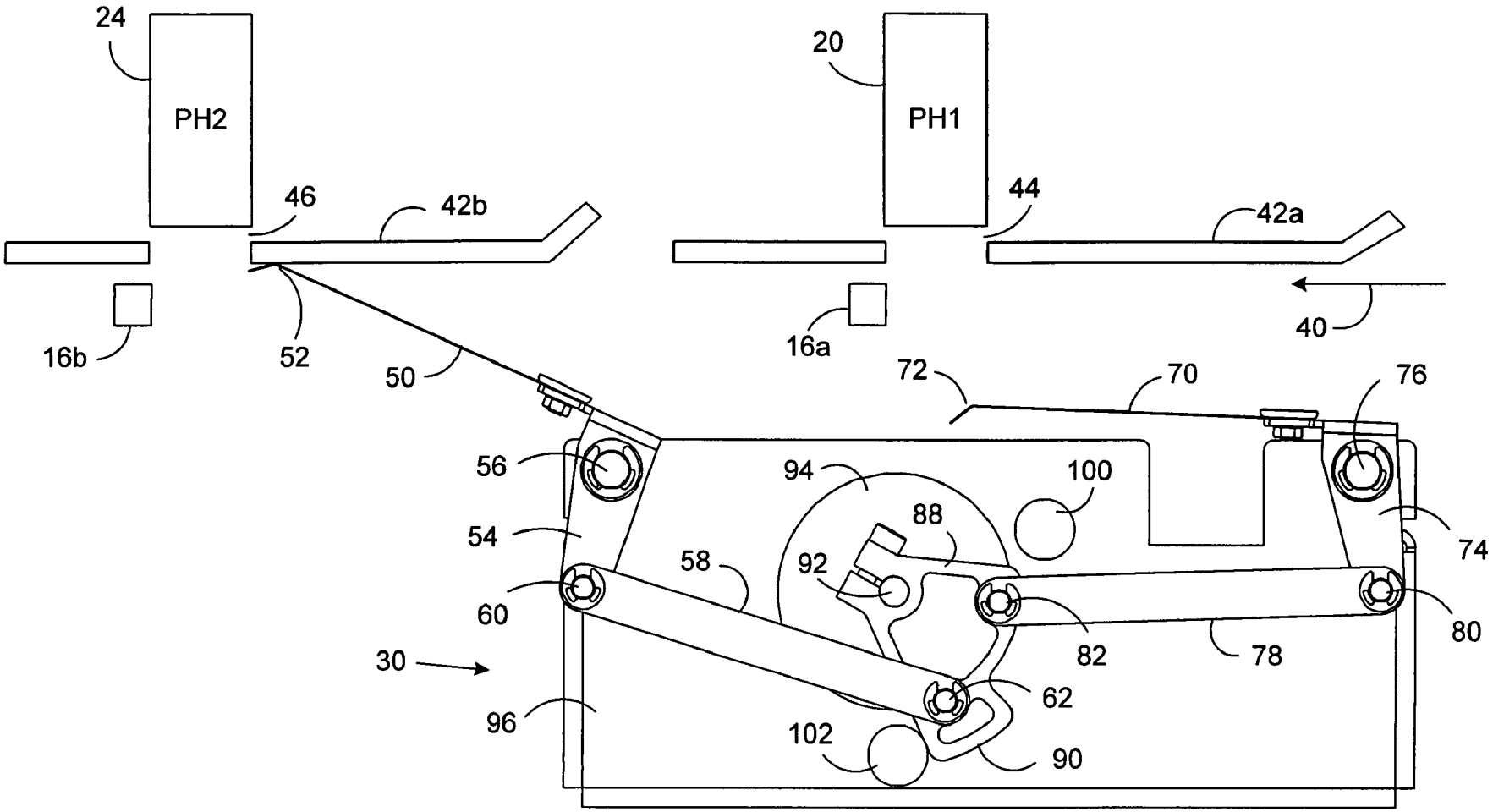
FIG. 2 illustrates a side view of a dynamic registration device, that can be used in the mailing system of FIG. 1, in a first position.
Figure 3:
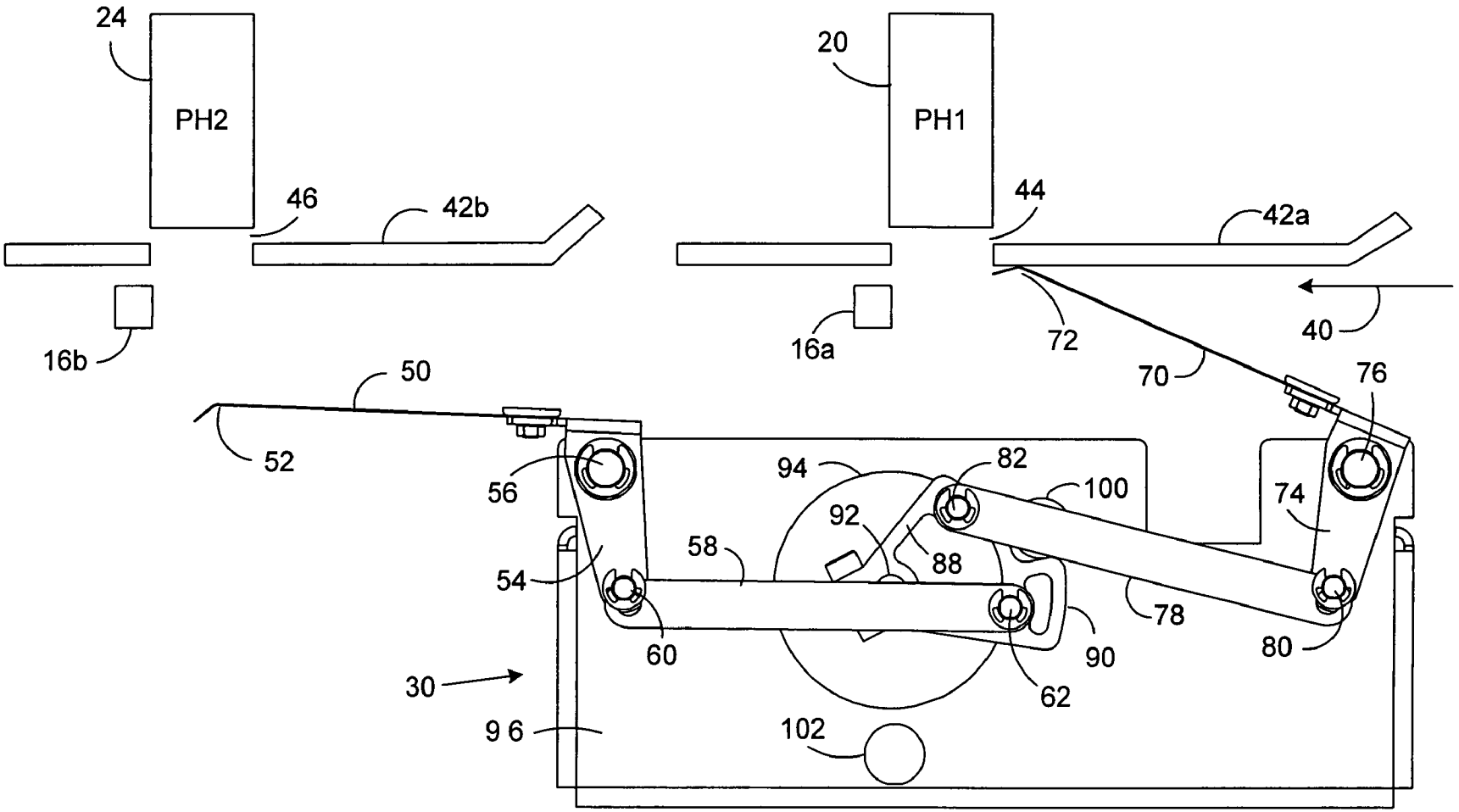
FIG. 3 illustrates the dynamic registration device in a second position.
Figure 4:
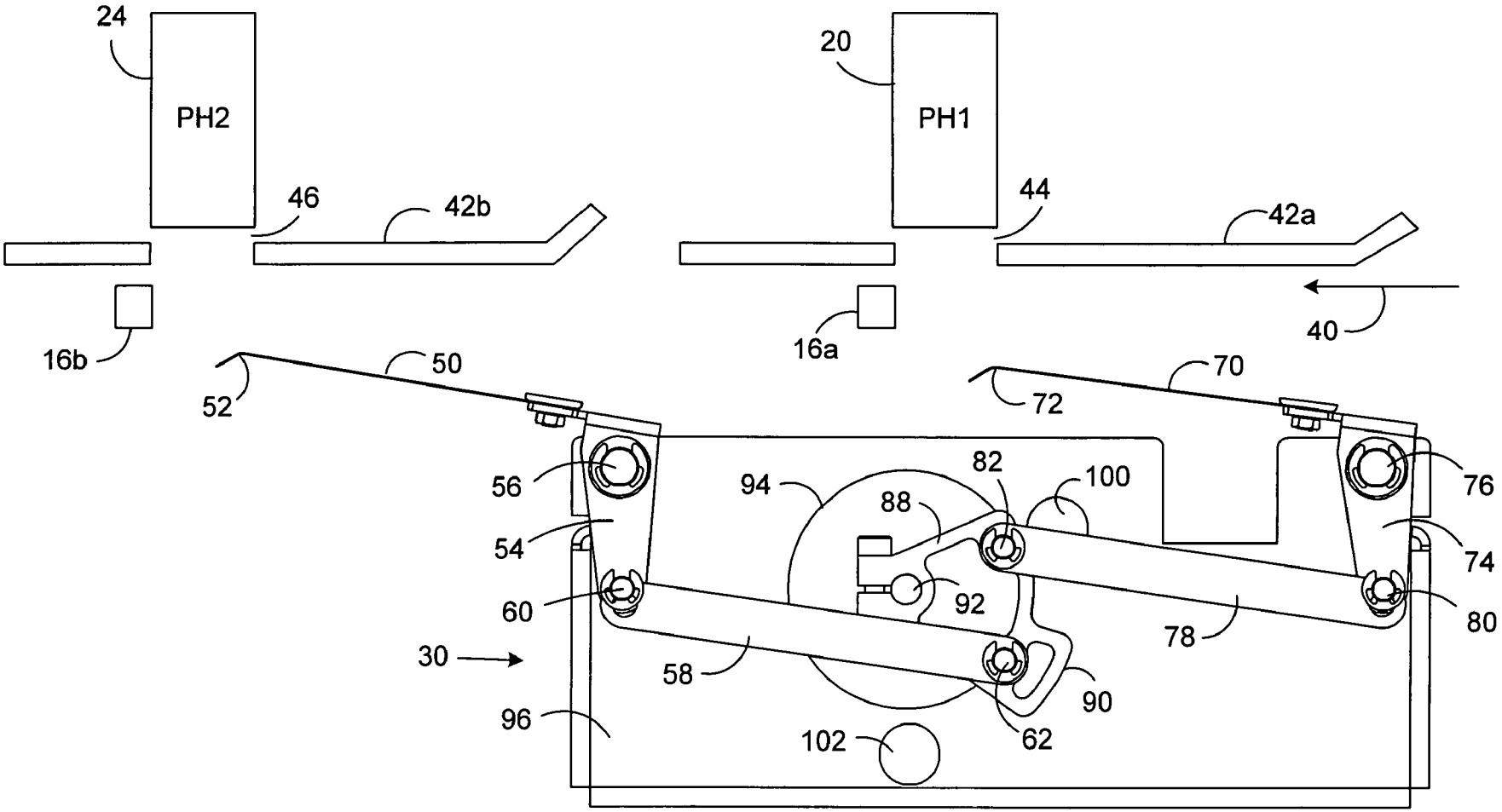
FIG. 4 illustrates the dynamic registration device in a third position.

Referring now to FIGS. 2–4, there is illustrated a more detailed view of portions of the mailing system 10, and more specifically a dynamic registration device according to an embodiment of the invention. As illustrated in FIG. 2, an article (not shown) upon which information will be imprinted is transported (by transport 14, not shown in FIGS. 2–4) in the direction of arrow 40 past the print heads PH1 20 and PH2 24. A registration plate, which may comprise one or more portions such as 42*a*, 42*b* as illustrated, is utilized to top register the articles such that a small predetermined gap is maintained between the exit plane of the nozzles of the print heads 20, 24 and the surface of the article. The print heads 20, 24 can print on the article through a respective slot 44, 46 in the registration plates 42*a*, 42*b* as the article passes. Slots 44, 46 can extend from the beginning of the print heads 20, 24 through the downstream ends of the registration plate 42*a*, 42*b*, respectively. Sensors, such as, for example, sensors 16*a* and 16*b*, which can be located at any point from slightly upstream to slightly downstream of the print heads 20, 24, provide signals to the main controller 12 (FIG. 1) to indicate the position of articles within the mailing system 10.

The articles are selectively registered against the one of the registration plates 42*a*, 42*b* by a biasing force that is applied by the actuator 30. Actuator 30 includes a pair of moveable skis 50, 70 that are utilized to apply pressure to the underside of an article such that it is top registered against a registration plate 42*a*, 42*b*. Ski 50 includes a contact portion 52 that will contact the underside of an article when the ski 50 is in the appropriate position, as described below, thereby top registering the article when being imprinted upon by print head PH2 24. Ski 50 is secured to a linking arm 54 that rotates about a fixed axis 56, which can be secured to a support bracket 96. Linking arm 54 is coupled to a linking arm 58 such that the linking arms 54, 58 can rotate with respect to each other about axis 60. The linking arm 58 is secured to a mounting bracket 88 such that it can rotate with respect to the mounting bracket 88 about an axis 62. The mounting bracket 88 includes a tab 90. Mounting bracket 88 is secured to the shaft 92 of a motor 94 such that when the motor 94 is energized and rotates the shaft 92, the mounting bracket 88 can also rotate until the tab 90 contacts one of the stops 100, 102 (depending upon which direction the shaft 92 is rotating) mounted to the support bracket 96. The motor 94 can also be mounted to the support bracket 96.

Ski 70 includes a contact portion 72 that will contact the underside of an article when the ski 70 is in the appropriate position, as described below, thereby top registering the article when being imprinted upon by print head PH1 20. Ski 70 is secured to a linking arm 74 that rotates about a fixed axis 76, which can be secured to the support bracket 96. Linking arm 74 is coupled to a linking arm 78 such that the linking arms 74, 78 can rotate with respect to each other about axis 80. The linking arm 78 is secured to the mounting bracket 90 such that it can rotate with respect to the mounting bracket 90 about an axis 82.

The operation of the dynamic registration device according to an embodiment of the invention is as follows. The position of the skis 50, 70 is controlled by selectively energizing the motor 94. When the mailing system 10 is powered for operation, one of the print heads 20, 24 will be designated as the active print head, i.e., the print head that will be printing, and the other will be designated as the inactive print head. Suppose, for example, the print head PH2 24 is designated as the active print head. It is therefore necessary to top register the articles as they are passing beneath the print head PH2 24 to ensure proper printing thereon. The main controller 12 will provide a signal to the actuator 30 to place the ski 50 into a registration position as illustrated in FIG. 2. The registration position is defined as the position in which a contact point of a ski contacts the registration plate or is within a very small distance from the registration plate, such as, for example, one or two millimeters. Thus, when ski 50 is in the registration position, the contact point 52 of ski 50 is in contact with or very close to the registration plate 42*b*. The positioning of the ski 50 is performed by energizing the motor 94 to rotate the shaft 92 into a position in which the ski 50 is in the registration position. As illustrated in FIG. 2, shaft 92 can be rotated in a clockwise direction until the tab 90 of the mounting bracket 88 contacts the stop 102. Rotation of the shaft 92 in the clockwise direction will cause the linking arm 58 to push the linking arm 54 such that the linking arm 54 rotates about the axis 56 in a clockwise direction, thereby causing the ski 50 to lift upward into the registration position. Thus, the contact portion 52 of the ski 50 contacts or is in very close proximity to the bottom of the registration plate 42*b* such that an article passing between the bottom of the registration plate 42*b* and the contact portion 52 of the ski 50 will be biased against the bottom of the registration plate 42*b* by the ski 50. Skis 50, 70 are preferably formed of a rigid yet flexible material, such as, for example, sheet metal, thereby providing a biasing force but still capable of being flexed. Thus, ski 50 provides a biasing force against the bottom of the registration plate 42*b* for articles passing between the contact point 52 and the registration plate 42*b*. If a thicker article is being processed by the mailing system 10, the ski 50 can flex such that the thicker article can pass between the contact portion 52 and the registration plate 42*b* while still being biased against the bottom of the registration plate 42*b*. Optionally, if the ski 50 is not flexible enough to accommodate very thick articles, the motor 94 can allow for some rotational movement due to the force applied by the article on the ski 50, thereby allowing the very thick articles to pass between the contact point 52 and the registration plate 42*b*.

As illustrated in FIG. 2, when ski 50 is moved into the registration position, the ski 70 is preferably concurrently moved into a non-registration position, i.e., a position in which the contact portion 72 of the ski 70 is not near the registration plate 42*a*. Thus, as articles of any thickness are transported past the print head PH1 20, there is no biasing force applied to the article, i.e., the articles are not top registered. This provides several advantages. For example, the amount of paper dust generated by friction of the article being top registered is reduced, as the article is only top registered when actually being printed upon instead of when passing under both the active and inactive print head.

Now suppose, for example, that print head PH1 20 will be designated as the active print head and print head PH2 24 will be designated as the inactive print head. This could be caused, for example, by print head PH2 24 requiring scheduled maintenance, e.g., wiping, purging, etc. It is therefore necessary to top register the articles as they are passing beneath the print head PH1 20 to ensure proper printing thereon. The main controller 12 will provide a signal to the actuator 30 to place the ski 70 into a registration position as illustrated in FIG. 3. To move the ski 70 from the non-registration position as illustrated in FIG. 2 to the registration position as illustrated in FIG. 3, the motor 94 is energized to rotate the shaft 92 in a counter-clockwise direction until the tab 90 of the mounting bracket 88 contacts the stop 100. For example, the stops 100, 102 can be positioned between 50 and 60 degrees apart, such that the shaft 92 can be rotated between 50 and 60 degrees. Preferably, the rotation of the shaft 92 from the position illustrated in FIG. 2 to the position illustrated in FIG. 3 is approximately 56 degrees. Rotation of the shaft 92 in a counter-clockwise direction will cause the linking arm 78 to pull the linking arm 74 such that the linking arm 74 rotates about the axis 76 in a clockwise direction, thereby causing the ski 70 to lift upward into the registration position. Thus, the contact portion 72 of the ski 70 contacts or is in very close proximity to the bottom of the registration plate 42*a* such that an article passing between the bottom of the registration plate 42*a* and the contact portion 72 of the ski 70 will be biased against the bottom of the registration plate 42*a* by the ski 70.

Movement of the ski 70 into the registration position will also concurrently cause the ski 50 to be moved into the non-registration position. The rotation of the shaft 92 in the counter-clockwise direction will cause the linking arm 58 to pull the linking arm 54 such that the linking arm 54 rotates about the axis 56 in a counter-clockwise direction, thereby causing the ski 50 to lower into the non-registration position. Thus, as articles of any thickness are transported by the print head PH2 24, there is no biasing force applied to the article, i.e., the articles are not top registered. This provides several advantages. For example, there is no risk that the ink printed on the articles by print head PH1 20 will be smeared due to contact with the registration plate 42*b* as the article passes under the print head PH2 24. Additionally, the amount of paper dust generated by friction of the article being top registered is reduced, as the article is only top registered when actually being printed upon instead of when passing under both the active and inactive print head. If the designation of the print heads again changes, i.e., print head PH2 24 is designated as the active print head and print head PH1 20 is designated as the inactive print head, the main controller 12 will send a signal to actuator 30 to place the ski 50 into the registration position as previously described above.

As illustrated in FIGS. 2 and 3, the biasing force to top register articles being passed under the print heads 20, 24 is applied only under the selected one of the print heads that is actually printing. Thus, the amount of paper dust generated can be reduced as compared with the amount generated if the articles were top registered under both print heads. In addition, if the first print head PH1 20 is the active print head, i.e., performing the print operation, there is no risk that the ink printed on the articles by print head PH1 20 will be smeared by contact with the registration plate 42*b* since the articles are not top registered as they pass under the print head PH2 24.

In other embodiments, the actuator 30 can additionally place both skis 50, 70 in an intermediate position between the registered and non-registered positions. In the intermediate position, neither ski 50 nor ski 70 will apply a biasing force to top register an article. This position is illustrated in FIG. 4, wherein the tab 90 of the mounting bracket 88 is located approximately halfway between the stops 100, 102. This intermediate position can be utilized between printing of different articles by the same print head to further reduce the generation of paper dust and prevent the trailing edge of the article from contacting the print head as it passes. For example, suppose print head PH2 24 is the designated active print head. The main controller 12 will have sent a signal to actuator 30 to move the ski 50 into the registration position as illustrated in FIG. 2. As the article passes under the print head PH2 24, the print head controller 22 will provide a signal to the print head PH2 24 to cause the print head PH2 24 to print. Once the print cycle has been completed, it is no longer necessary to maintain the article in a top registered position. Upon completion of the print cycle for the article, the print head controller 22 sends a signal to the main controller 12, which in response sends a signal to the actuator 30 to position the ski 50 in the intermediate position. The motor 94 will be energized to rotate the shaft 92 in a counter-clockwise direction a predetermined distance, thereby lowering the ski 50 from the registration position to the intermediate position. Thus, as the remaining portion of the article passes under the print head PH2 24, it will not be top registered, thereby reducing the generation of paper dust and the risk of the trailing edge of the article contacting the print head PH2 24 through the slot 46. For example, if the article is a mail piece, the location of an indicium evidencing payment of postage must be located in a specified location, e.g., the upper right hand corner of the face of the mail piece. For a standard size envelope, the indicium occupies only a small portion of the length of the envelope. Thus, when the indicium is finished being printed, the biasing force on the envelope can be removed, thereby allowing the remaining length of the envelope to pass under the print head PH2 24 without being top registered.

When the trailing edge of the article is detected by sensor 16*b*, the main controller 12 will send a signal to the actuator 30 to place the ski 50 back into the registration position, as described above and illustrated in FIG. 2, such that the next article to arrive will be top registered. Thus, the trailing edge of the article will have passed by the print head PH2 24 before the ski 50 is placed back into the registration position. Since the gap between articles may be very small, especially in high speed systems with large throughputs, the use of the intermediate position, in which the distance the skis 50, 70 must travel is minimized, assures that the ski 50 will be back in the top registration position before the next article arrives for printing.

The operation of the actuator 30 when the print head PH1 20 is the active printer is similar. Upon completion of the print cycle for the article, the print head controller 18 sends a signal to the main controller 12, which in response sends a signal to the actuator 30 to position the ski 70 in the intermediate position. The motor 94 will be energized to rotate the shaft 92 in a clockwise direction a predetermined distance, thereby lowering the ski 70 from the registration position to the intermediate position. Thus, as the remaining portion of the article passes under the print head PH1 20, it will not be top registered, thereby reducing the generation of paper dust and the risk of the trailing edge of the article contacting the print head PH1 20 through the slot 44. When the trailing edge of the article is detected by sensor 16*a*, the main controller 12 will send a signal to the actuator 30 to place the ski 70 back into the registration position, as described above and illustrated in FIG. 3, such that the next article to arrive will be top registered.

It should be understood that while the above description was with respect to a mailing system 10 having multiple print modules, other embodiments can also be utilized with only a single print module. For example, the actuator 30 need only be provided with a single ski that can be moved between the registration position and the intermediate position, thereby reducing the amount of paper dust generated by the mailing system and the risk of the trailing edge of the article contacting the print head as it passes beneath.

Those skilled in the art will also recognize that various modifications to the above embodiments can be made. For example, the position of the shaft 92 can be controlled utilizing any conventional means, including rotary solenoids, torque actuators and the like. The skis 50, 70 can also be formed of any type of material that is rigid enough to provide a biasing force, yet flexible enough to accommodate articles of various thickness.

While preferred embodiments of the invention have been described and illustrated above, it should be understood that they are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A registration device for a mailing system comprising:

a first biasing means to apply a biasing force to an article to register the article against a registration plate during printing by a first print head;

a second biasing means to apply a biasing force to an article to register the article against a registration plate during printing by a second print head; and actuator means coupled to the first biasing means and the second biasing means, the actuator means controlling a position of the first biasing means being movable between a plurality of positions for and the second biasing means to selectively apply and remove the biasing force, wherein the position of the actuator means determines which one of the first and second biasing means will apply the biasing force.

2. The registration device of claim 1, wherein at least one of the first biasing means and second biasing means is a ski.

3. The registration device of claim 2, wherein the ski is formed of a flexible material.

4. The registration device of claim 1, wherein the actuator means is a rotary actuator that when rotated controls the position of the first biasing means and the second biasing means.

5. The registration device of claim 4, wherein the rotary actuator includes a shaft of a motor.

6. The registration device of claim 1, wherein the biasing force is applied to the article by the first biasing means only when the article is being imprinted upon by the first print head, and the biasing force is applied to the article by the second biasing means only when the article is being imprinted upon by the second print head.

7. The registration device of claim 1, wherein the biasing means has a first position in which the first biasing means applies the biasing force and the second biasing means does not apply the biasing force, and a second position in which the first biasing means does not apply the biasing force and the second biasing means applies the biasing force.

8. The registration device of claim 7, wherein the biasing means has a third position in which both the first and second biasing means do not apply the biasing force.

9. A mailing system comprising:

a transport device to transport an article through a feed path of the mailing system;

a first print module located along the feed path;

a second print module located along the feed path downstream from the first print module, only one the first and second print modules being active at a time; and a registration device to register an article against a registration plate beneath the active one of the first and second print modules, the registration device including:

a first biasing means to apply a biasing force to the article to register the article against the registration plate during printing by the first print module;

a second biasing means to apply a biasing force to the article to register the article against the registration plate during printing by the second print module; and an actuator device coupled to the first biasing means and the second biasing means, the actuator device controlling a position of the first and second biasing means to selectively apply and remove the biasing force.

10. The mailing system of claim 9, wherein the first and second biasing means are skis.

11. The mailing system of claim 10, wherein the skis are formed of a flexible material.

12. The mailing system of claim 9, wherein the actuator device is a rotary actuator that when rotated controls the position of the first and second biasing means.

13. The mailing system of claim 12, wherein the rotary actuator includes a shaft of a motor.

14. The mailing system of claim 9, wherein when the first print module is active, the biasing force is applied to the article by the first biasing means only when the article is being imprinted upon by the first print module.

15. The mailing system of claim 9, wherein when the second print module is active, the biasing force is applied to the article by the second biasing means only when the article is being imprinted upon by the second print module.

16. A mailing system for processing mail pieces including printing on an upper surface of a mail piece passing through the mailing system, the mailing system comprising:

a first printing device including a first print head having a plurality of nozzles disposed in a predetermined plane to deposit ink on the upper surface of a mail piece;

a second printing device including a second print head having a plurality of nozzles disposed in a predetermined plane to deposit ink on the upper surface of a mail piece;

a registration plate arranged to register the upper surface of a mail piece at a predetermined distance beneath the plurality of nozzles of the first print head and the plurality of nozzles of the second print head;

a transport device to transport a mail piece under the plurality of nozzles of the first print head and the plurality of nozzles of the second print head;

a first ski to apply a biasing force to a lower surface of the mail piece to register the upper surface of the mail piece against the registration plate beneath the first printing device;

a second ski to apply a biasing force to a lower surface of the mail piece to register the upper surface of the mail piece against the registration plate beneath the second printing device; and an actuator device coupled to the first ski and the second ski, the actuator device controlling a position of the first ski to selectively apply the biasing force when the first printing device is printing on the mail piece and to remove the biasing force when the printing has been completed by the first printing device, the actuator device controlling a position of the second ski to selectively apply the biasing force when the second printing device is printing on the mail piece and to remove the biasing force when the printing has been completed by the second printing device, wherein only one of the first and second printing device is active at a time, and the actuator device controls a position of the first and second ski to selectively apply the biasing force only beneath the active print device when the active print device is printing.

17. The mailing system of claim 16, wherein the actuator device includes a motor having a shaft, the shaft being coupled to the first ski by a linking mechanism, wherein rotation of the shaft by the motor in a first direction causes the first ski to move into a first position to apply the biasing force, and rotation of the shaft by the motor in a second direction opposite the first direction causes the first ski to move into a second position to remove the biasing force.

18. A mailing system for processing mail pieces including printing on an upper surface of a mail piece passing through the mailing system, the mailing system comprising:

a printing device including a print head having a plurality of nozzles disposed in a predetermined plane to deposit ink on the upper surface of a mail piece;

a registration plate arranged to register the upper surface of a mail piece at a predetermined distance beneath the plurality of nozzles of the print head;

a transport device to transport a mail piece under the plurality of nozzles;

a first ski to apply a biasing force to a lower surface of the mail piece to register the upper surface of the mail piece against the registration plate beneath the printing device;

an actuator device coupled to the first ski, the actuator device controlling a position of the first ski to selectively apply the biasing force when the printing device is printing on the mail piece and to remove the biasing force when the printing has been completed by the printing device; and a sensor to detect when a trailing edge of the mail piece is passing the printing device, wherein the actuator device in response to the trailing edge being detected positions the first ski to apply the biasing force for a next mail piece.

* * * * *

UNITED STATES PATENT AND TRADEMARK OFFICE

CERTIFICATE OF CORRECTION

PATENT NO. : 6,966,711 B2
APPLICATION NO. : 10/742305
DATED : November 22, 2005
INVENTOR(S) : John P. Miller, Lun Chan and Anthony E. Yap It is certified that error appears in the above-identified patent and that said Letters Patent is hereby corrected as shown below:

Column 9, line 27, before "controlling" insert --being movable between a plurality of positions for--.

Column 9, lines 28-29, delete "being movable between a plurality of positions for".

Signed and Sealed this

Eighteenth Day of March, 2008

JON W. DUDAS
*Director of the United States Patent and Trademark Office*